United States Patent [19]

Namiki et al.

[11] 4,229,644

[45] Oct. 21, 1980

[54] HEAT PIPE ROLLER

[75] Inventors: Ryoichi Namiki, Hino; Yasuro Hayashi, Yokohama, both of Japan

[73] Assignee: Ricoh Company, Ltd., Japan

[21] Appl. No.: 842,099

[22] Filed: Oct. 14, 1977

[30] Foreign Application Priority Data

Oct. 20, 1976 [JP] Japan ..... 51/125914
Nov. 30, 1976 [JP] Japan ..... 51/143794

[51] Int. Cl.[3] ..... F28D 11/02; F28F 5/02

[52] U.S. Cl. ..... 219/469; 219/470; 165/89; 34/124; 29/129.5; 29/125

[58] Field of Search ..... 219/469, 470, 10.49; 165/89, 90; 34/119, 124, 125, 105; 29/121.5, 120.6, 125, 129.5, 110, 506, 507, 508, 513, 516, 517, 518, 130, 129; 138/148, 155

[56] References Cited

U.S. PATENT DOCUMENTS

| | | | |
|---|---|---|---|
| 1,062,170 | 5/1913 | Lauhoff | 165/90 |
| 1,218,895 | 3/1917 | Porter | 138/148 |
| 1,643,145 | 9/1927 | Winkler | 29/130 |
| 2,545,917 | 3/1951 | Cowie | 165/89 |
| 2,710,677 | 6/1955 | Ferris | 29/517 |
| 2,739,219 | 3/1956 | Wennerlund | 219/469 |
| 2,831,097 | 4/1958 | Malewski | 219/470 |
| 3,099,993 | 8/1963 | Smith | 138/148 |
| 3,355,817 | 12/1967 | Birk | 165/89 |
| 3,495,951 | 2/1970 | Tanaka et al. | 165/89 |
| 3,907,965 | 9/1975 | Hoshino et al. | 165/90 |
| 3,967,386 | 7/1976 | Asfura | 165/89 |

FOREIGN PATENT DOCUMENTS

| | | | |
|---|---|---|---|
| 496543 | 4/1930 | Fed. Rep. of Germany | 165/90 |
| 1003547 | 2/1957 | Fed. Rep. of Germany | 165/90 |
| 742427 | 3/1933 | France | 219/470 |
| 50878 | 4/1931 | Norway | 165/90 |
| 242454 | 11/1925 | United Kingdom | 165/89 |
| 287023 | 3/1928 | United Kingdom | 29/517 |
| 602251 | 5/1948 | United Kingdom | 165/89 |

*Primary Examiner*—Elliot A. Goldberg
*Assistant Examiner*—Bernard Roskoski
*Attorney, Agent, or Firm*—McGlew and Tuttle

[57] ABSTRACT

A heat pipe roller comprising an inner pipe, an outer pipe, and a chamber formed by the inner pipe and the outer pipe, containing a heating medium, wherein the inner pipe and the outer pipe are sealed above one portion of each end of the heat pipe roller.

4 Claims, 11 Drawing Figures

HEAT PIPE ROLLER

BACKGROUND OF THE INVENTION

This invention relates to a heat pipe roller, and more particularly a heat pipe roller comprising an inner pipe having heating means therein, an outer pipe, and a chamber for holding a heating medium, formed by the inner cylinder and the outer cylinder.

DESCRIPTION OF THE PRIOR ART

In electrophotographic copying apparatus, a heating roller is employed for fixing an image. In order to make the fixing temperatures uniform on the heating roller, the heating roller comprising an inner cylinder or pipe, an outer cylinder or pipe, and a vacant space or chamber formed between the inner pipe and the outer pipe which contains a liquid heating medium therein, is devised, so that heat from a heater disposed in the heating roller can be transferred speedily to the outer surface of the heating roller.

A conventional heating roller of this kind is shown in FIG. 1. In the figure, outer pipe 1 and inner pipe 2 are made in the shape of a perfect cylinder. Ring-shaped side plates 3, 4 are fitted in both ends of the two pipes. The ring-shaped side plates are sealed at two sealing portions 5, 6 at both ends of the two pipes. The inner pipe 2 is fixed at the bosses of the shafts 7, 8. Liquid heating medium 10 is placed in chamber 9.

In this conventional heating roller, since there are two sealing portions for the inner pipe and the outer pipe at both ends of the heating roller, the fitting accuracy of the inner and outer pipes and the side plates must be high. Thus the assembling of the heating roller of this kind is difficult. This is a shortcoming of this type of heating roller. Furthermore, since the above-mentioned chamber 9 has to be made airtight, it is preferable for the number of the sealing areas between cylinders to be fewer.

SUMMARY OF THE INVENTION

It is therefore an object of the present invention to provide a heat pipe roller whose component parts and sealing portions are reduced in number, and whose assembling is simplified.

In one embodiment of the heat pipe roller according to the invention, the inner pipe and the outer pipe have a large diameter portion and a small diameter portion, and the large diameter portion of the inner pipe is fitted in the large diameter portion of the outer pipe, and the small diameter portion of the inner pipe is fitted in the small diameter portion of the outer pipe so that the inner pipe and the outer pipe are sealed above one portion of each end of the heat pipe roller.

In another embodiments of the invention, the inner pipe has a small diameter portion at both ends of the pipe, respectively, and a large diameter portion in between; the outer pipe is mounted on the large diameter portion of the inner pipe. Thus the inner pipe and the outer pipe are sealed above one portion of each end of the heat pipe roller.

According to the present invention, the necessary parts and sealing portions of the heat pipe roller are reduced in number, and thus the assembling is simplified. Accordingly the production cost and time is significantly reduced. Furthermore, the leakage of the heating medium is completely obviated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
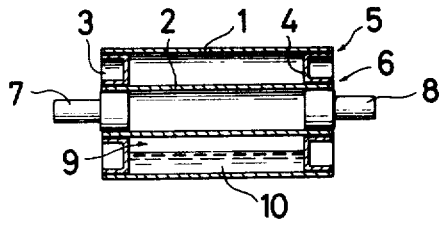
FIG. 1 PRIOR ART
FIG. 1 is a schematic elevation of a conventional heat pipe roller.
Figure 2:
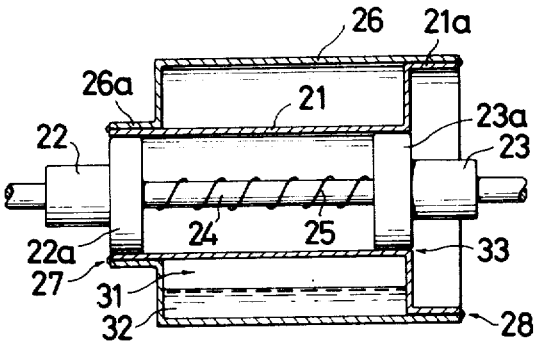
FIG. 2 is a schematic elevation of one embodiment of the heat pipe roller according to the present invention.

In FIG. 2, bosses 22*a*, 23*a* of shafts 22, 23 are fixedly fitted in the small diameter portions of an inner pipe 21. Thus the inner pipe is fixed. A heater 25 is mounted on a shaft 24 which is integral with both shafts 22, 23. A flange and end portion or large diameter portion 21*a* is formed at one end of the inner pipe 21 in the shape of a step. The large diameter portion of the inner pipe 21 is fitted in the large diameter portion of an outer pipe 26, and the other end portion of the inner pipe 21 is fitted in the small diameter portion of the outer pipe 26. In this construction, there is only one sealing area along each end of the heating pipe, that is, the sealing portion 27 of the inner pipe 21 and one end portion of the outer pipe 26, and the sealing portion 28 of the inner pipe 21 and the other end portion of the outer pipe 26. Furthermore, the respective diameters of the sealing portions are different. A chamber 31, formed by the inner pipe 21 and the outer pipe 26, contains a heating medium 32 comprising SK oil, KSK oil (manufactured by Soken Chemical Co., Ltd.), or the like. It is preferable that the degree of vacuum in the chamber 31 is approximately $10^{-5}$ Torr l/sec. However, since the evaporation of the heating medium in the chamber is promoted under reduced pressure, the degree of vacuum in the chamber is not limited to the above-mentioned value. Also it is unnecessary to evacuate the chamber, unless some adverse effect is realized by the heating medium being heated without evacuating the chamber.

The outer and inner pipes 21, 26 are made of metal and produced by pressing, blister processing, or the like. The sealing portions 27, 28, 33 are welded by argon welding, carbon dioxide welding or sealed by brazing. The strength of the outer pipe 26 should be greater than that of the inner pipe 21. When the heating medium 32, heated by the heater 25, is vaporized, the pressure in the chamber becomes 1 atm or more, and occasionally, it becomes 50 atm or more. The heat of the vaporized heating medium is transferred speedily to the outer pipe 26 so that a predetermined temperature can be reached in a short time. Moreover, the temperature distribution in the axial direction of the heating roller becomes uniform.

Figure 3:
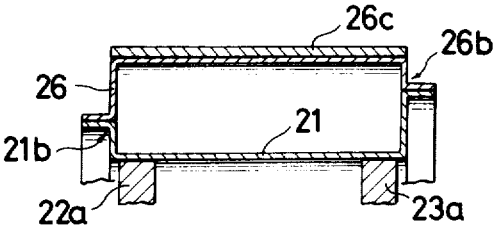
FIG. 3 is a partial sectional view of another embodiment of the heat pipe roller of the invention.

FIG. 3 shows another embodiment of the heat pipe roller according to the present invention. In this embodiment, step portions or second end and flange portions 21*b*, 26*b* are formed in the small diameter portion of the inner pipe 21 and in the large diameter portion of the outer pipe 26, respectively. By forming the step portions 21*b*, 26*b*, the assembling of the heat pipe roller is simplified. Also this embodiment has another advantage that it is unnecessary to cut the welding surface in the finishing process of the heat pipe roller. In other words, the cutting of the welding surface results in reducing the airtightness considerably. After welding each sealing portion, the outer peripheral portion 26*c* of the outer pipe is cut so as to make the diameter of the heat pipe roller uniform.

Figure 4A:
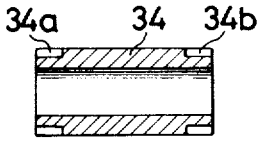
FIG. 4(*a*) to (*c*) shows an example of the procedure of forming the outer pipe in a further embodiment of the heat pipe roller of the invention.
Figure 4B:
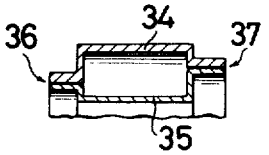
Figure 4C:
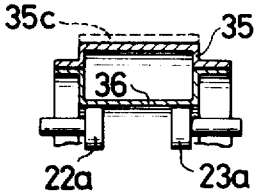
Figure 5:
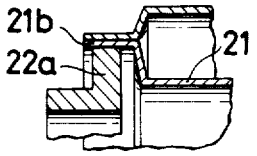
FIG. 5 shows another joining procedure of the shaft and the inner pipe of the present invention.
Figure 6:
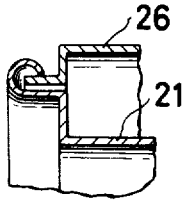
FIG. 6 shows another adjoining procedure of the inner pipe and the outer pipe of the invention.

The procedure of forming the outer pipe 26 is as follows. As shown in FIG. 4 (*a*), outer peripheral portions 34*a*, 34*b* at both ends of the pipe 34 are cut off. Then the above-mentioned step portions are formed by pressing or other processings. Furthermore, as shown in FIG. 4 (*b*), the inner pipe 35 is fitted in the outer pipe 34. Then the sealing portions 36, 27 are welded. After the inner pipe 36 is fixed on the bosses 22*a*, 23*a* of the shaft, the outer surface 35*c* of the outer pipe 35 is roughened, and swaged as shown in FIG. 4 (*c*). Alternatively, the boss 22*a* can be sealed by fitting it in the other step portion 21*b* of the inner pipe 21 as shown in FIG. 5. Also, the sealing portion of the inner pipe 21 and the outer pipe 26 can be welded after bending the step portion of the inner pipe 21 as shown in FIG. 6. With respect to heating means, the inner pipe or the outer pipe can be heated by induction heating instead of the heater.

Figure 7:
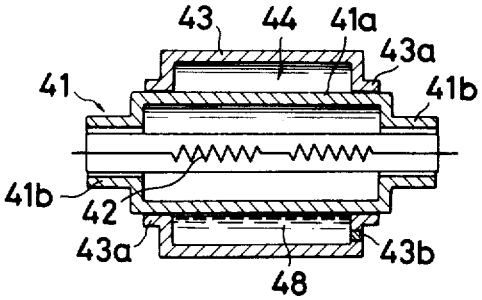
FIG. 7 is a schematic elevation of a further embodiment of the heat pipe roller of the invention.

FIG. 7 shows a further embodiment of the heat pipe roller of the invention. In the figure, an inner pipe 41, made of a heat resisting material and subjected to blister processing to obtain airtightness, has a large diameter portion or joint portion 41*a* where outer pipe is attached, and small or reduced diameter portions 41*b* which serve as a shaft of the inner pipe 41. Inside the shaft portion 41*b* is mounted means (not shown) for supporting heating means 42. The shaft portion 41*b* is rotatably supported by a supporting member (not shown).

Welding base 43*a* of the outer pipe 43 having a chamber for holding a heating medium, is in contact with both peripheral end portions of the joint portion 41*a*. The inner pipe 41 and the outer pipe 43 are made integral by welding the welding base 43*a* and the joint portion 41*a*. At an end portion of the outer pipe 43, injection hole 43*b* is formed for injecting the heating medium 48 into the chamber 44. The injection hole 43*b* is sealed when a predetermined amount of the heating medium 48 has been injected into the chamber 44 of the outer pipe 43.

In the thus constructed heat pipe roller, the inner pipe 41, which is integral with the shaft portion 41*b*, and the outer pipe 43 are fixed integrally so as to keep airtightness by welding, brazing, or other appropriate means. Then the heating medium 48 is injected into the chamber 48 of the outer pipe 43.

At this time, the chamber of the outer pipe is kept at not more than 1 atm, preferably in vacuo. The reason why the vacuum condition is preferable is that the heating medium is apt to be oxidized.

However, in the case where the heating medium is difficult to be oxidized or not oxidized, it is unnecessary to keep the chamber in vacuo.

After the heating medium 48 is injected, the chamber 44 is again kept in vacuo and the heating medium is sealed in the chamber by closing the injection hole 43*b*. Thus the heating roller is constructed.

The thus constructed heat pipe roller is utilized as a heating roller of heat fixing apparatus for use in the copying apparatus. In the heat pipe roller employed as a heating roller, when the heating means 42 is energized, the inner pipe 41 is heated and accordingly the heating medium 48 is heated as well, whereby the chamber of the outer pipe 43 is filled with the vapor of the heating medium so that the temperature of the surface of the outer pipe 43 is kept at a predetermined fixing temperature.

A toner image bearing supporting material is carried onto the heat pipe roller, where the supporting material is heated and the toner image is fixed on the supporting material. In this embodiment, a heater is used as the heating means 42. However, an induction means (not shown) for heating directly the inner pipe or the outer pipe can be employed instead.

The ratio of the diameter of the inner pipe 41 to that of the outer pipe 43 is approximately 1:1.5 to 3.0. The essential point is that the ratio is such that at least a slight gap can be formed between the inner pipe 41 and the outer pipe 43. In order to obtain a satisfactory strength of the heat pipe roller, the thickness of the respective pipes is determined in accordance with the vapor pressure and heat resistance of the heating medium. Since the vapor pressure varies in the range of not more than 1 atm to 30–50 atm, and occasionally up to approximately 100 atm, the strength of the pipes has to be determined so as to be capable of resisting such pressure and heat.

Water, Dowtherm A, E, or KSK oil (trade name), whose respective boiling points are in the range of 10° to 350° C. at atmospheric pressure, can be employed as the heating medium 48.

Figure 8:
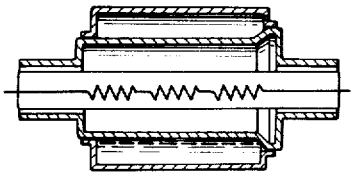
FIG. 8 is a schematic elevation of a further embodiment of the heat pipe roller of the invention.
Figure 9:
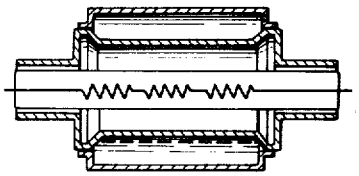
FIG. 9 is a schematic elevation of a further embodiment of the heat pipe roller of the invention.

In the heat pipe roller according to the invention, the inner pipe 41 and the outer pipe 43 can be modified in shape as shown in FIGS. 8 and 9 with second reduced area portions in order to facilitate the joining of the pipes. Furthermore, blades can be mounted on the inner pipe 41 in order to stir the heating medium 48. Also the shaft portions can be strengthened by covering with pipes having almost the same shape as that of the shaft portions.

While specific embodiments of the invention have been shown and described in detail to illustrate the application of the principles of the invention, it will be understood that the invention may be embodied otherwise without departing from such principles.

What is claimed is:

1. A heating roller for fixing an image in a copying apparatus comprising, a one piece inner cylinder having one small diameter end portion and one opposite large diameter end portion, heating means disposed within said inner cylinder, a one piece outer cylinder having a small diameter end portion and a large diameter end portion disposed around said inner cylinder which is inserted onto said inner cylinder in the axial direction of said inner cylinder with said outer cylinder large diameter end portion inserted first onto said inner cylinder small diameter end portion, said outer cylinder large and small end portions airtightly fixed to said large and small end portions of said inner cylinder respectively along two sealing areas of mutual surface contact therebetween, with a space defined in an uncontacting portion between said outer cylinder and said inner cylinder, heating medium which is evaporated under application of heat by said heating means held in said space, and stop means which is disposed in an end wall which forms said space, said stop means being for reducing the pressure within said space in order to place and seal said heating medium in said space.

2. A heating roller according to claim 1 further including opposite reduced diameter portions of equal diameters extending from said small and large diameter end portion of said inner cylinder forming a shaft of rotation for said heating roller.

3. A heating roller according to claim 1 further including a smaller diameter portion between said small and large diameter end portions of said inner cylinder to form said space defined between said inner and outer cylinders.

4. A heating roller according to claim 1 wherein said outer cylinder includes a larger diameter portion between said small and large diameter end portions of said outer cylinder for defining said space between said inner and outer cylinders.

* * * * *